US005590842A

United States Patent [19]

Zehr

[11] Patent Number: 5,590,842

[45] Date of Patent: Jan. 7, 1997

[54] CONVEYOR WITH EXTENDING SHROUD

[76] Inventor: Melvin A. Zehr, Box 266, Middleton, Id. 83644

[21] Appl. No.: 410,700

[22] Filed: Mar. 27, 1995

[51] Int. Cl.[6] ..... B02C 13/286

[52] U.S. Cl. ..... 241/186.35; 241/186.4; 241/605

[58] Field of Search ..... 241/101.761, 186.35, 241/186.4, 605, 189.1

[56] References Cited

U.S. PATENT DOCUMENTS

| | | | |
|---|---|---|---|
| 2,385,341 | 9/1945 | Krause et al. | 241/186.35 X |
| 4,034,920 | 7/1977 | Bradley | 241/101.7 |
| 4,187,047 | 1/1980 | Squifflet, Sr. | 414/332 |
| 4,249,351 | 2/1981 | Brock | 52/64 |
| 4,482,281 | 11/1984 | Musil | 414/332 |
| 4,997,135 | 3/1991 | Zehr | 241/101 |
| 5,181,663 | 1/1993 | Dorscht et al. | 241/81 |
| 5,375,784 | 12/1994 | Worley | 241/37.5 |
| 5,452,861 | 9/1995 | Faccia | 241/101.72 |

*Primary Examiner*—John M. Husar
*Attorney, Agent, or Firm*—Frank J. Dykas

[57] ABSTRACT

A transportable conveyor system for use primarily with a pivot tub type hammermill having a frame, a conveyor means installed within the frame, for transporting the material to be ground or pulverized to the hammermill, sideboards or rails located on either side of the lower end of the conveyor frame for containing the material to be ground or pulverized on the conveyor means, a fixed shroud located at the upper end of the conveyor frame assembly extending upward from the frame and across the top of the conveyor means creating an enclosure through which the material to be ground or pulverized travels, an extendable shroud which is mounted on a pair of trolleys, one trolley mounted on either side of the conveyor frame assembly, each trolley traveling on a pair of wheels which in turn travel in a track attached to the sides of the conveyor frame assembly, the conveyor system having means for driving the trolley wheels along the track causing the extendable shroud to extend beyond the end of the conveyor frame assembly, the trolley also having means for tilting the extendable shroud to level the shroud over the pivot tub of a pivot tub type hammermill. The conveyor frame assembly is provided with means for inclining the conveyor frame assembly from a trailer bed, the trailer bed having wheel assemblies for transport and jack assemblies for positioning and stabilizing the entire apparatus.

2 Claims, 6 Drawing Sheets

CONVEYOR WITH EXTENDING SHROUD

BACKGROUND OF THE INVENTION

1. Technical Field

This invention relates generally to conveyors, and more specifically to conveyors which are used for feeding raw materials into grinders and hammermills, more particularly a conveyor for use with mobile wood choppers and refuse grinders of the pivot-tub type.

2. Background

The utility of wood choppers and refuse grinders, particularly of the pivot tub type are well known. Also well known in the art is the desirability of providing a means for transporting a grinder or hammermill to an area where material is to be ground or pulverized. See Zehr, U.S. Pat. No. 4,997,135.

It is desirable to provide a means for conveying material to be ground or pulverized to the pivot tub for ultimate presentation to the grinder or hammermill. Conveyor means for use with mobile grinders or hamermills must meet the same requirements as the mill itself for transportation, that being that the apparatus must conform to the rules of the road, particularly in reference to width. Additionally, it is desirable for the apparatus to be capable of being reconfigured to provide a lower profile for transportation.

Conveyors for feeding various hoppers and bins have been described in a number of publications. In Squifflet, U.S. Pat. No. 4,187,047, a silo and elevator structure which is transportable by trailer bed is described. The Squifflet conveyor erects vertically and transports material, in this case an asphalt mix, to a silo which in turn is erected in such a manner so that trucks may be loaded from the silo.

In Brock, U.S. Pat. No. 4,249,351, a self erecting apparatus for transporting and temporarily storing material such as asphalt, including a surge bin, a drag chute and a conveyor for transporting the asphalt to the surge bin is described.

Similarly, in Musil, U.S. Pat. No. 4,482,281, a portable asphalt storage silo with a conveyor assembly including a wheeled frame for transport is described.

While each of these patents describes a transportable conveyor means for use with a hopper or bin, each described invention solves a different set of objectives than those presented by the needs of those who operate transportable hammermills, particularly those of the pivot tub type.

A hammermill consists essentially of a drum having a plurality of impact members affixed to the surface of the drum. The impact members may be in the nature of knives for chopping wood; hammers for pulverizing refuse; or may have other characteristics, depending upon the material to be worked.

The hammermill extends upwardly through the floor of a tub to engage material contained within the tub. Below the hammermill a conveyor is located which removes the pulverized material from the mill. A pivot tub consists of a tub with a cylindrical, rotatable side wall and a non rotatable floor. Typically the tub assembly is mounted to a frame in a manner so that the tub may be pivoted away from the mill so that debris may be cleaned or emptied from the mill. Some means is typically employed for introducing material into the pivot tub.

One problem which typically occurs in the operation of hammermills of this type is that material which is introduced into the tub, upon impact with the hammermill, has a tendency to be violently rejected by the mill and ejected from the tub.

The use of a shield to prevent violent rejection of material from the grinder or hammermill and the associated potential for injury from such flying debris is discussed in Zehr, U.S. Pat. No. 4,997,135. However, the use of such a shield does not prevent entirely, the possibility of such flying debris.

What is needed then, is a means for introducing material which is to be ground or pulverized into the pivot tub of the hammermill, which will provide some means for preventing the materials so introduced from being violently rejected from the mill. In addition, the conveyor means, while it should extend over and above the pivot tub of the hammermill, it should be configured such that it is capable of being retracted from that position so that the pivot tub of the hammermill can be pivoted away from the floor of the mill to facilitate cleaning and servicing the mill.

Additionally, the conveyor means should be readily transportable.

DISCLOSURE OF INVENTION

The present invention comprises, generally, a conveyor system having a frame, a conveyor means installed within the frame, for transporting the material to be ground or pulverized along the conveyor, sideboards or rails located on either side of the lower end of the conveyor frame for containing the material to be ground or pulverized on the conveyor means, a fixed shroud located at the upper end of the conveyor frame assembly extending upward from the frame and across the top of the conveyor means creating an enclosure through which the material to be ground or pulverized travels, an extendable shroud which is mounted on a pair of trolleys, one trolley mounted on either side of the conveyor frame assembly, each trolley being slidably mounted on and traveling on a conveyance means, in the case of the preferred embodiment, a pair of wheels which in turn travel in a channel or a track which forms integral portion of the sides of the conveyor frame assembly, the trolley having means for driving the trolley wheels along the track or channel so as to cause the extendable shroud to extend along the length of the conveyor frame assembly and beyond the end of the conveyor frame assembly, the trolley also being additionally equipped with a means for tilting the extendable shroud to level the shroud over the pivot tub of a pivot tub type hammermill.

In addition, the conveyor frame assembly is provided with means for inclining the conveyor frame assembly from a trailer bed, the trailer bed having wheel assemblies for transport and jack assemblies for positioning and stabilizing the entire apparatus.

It is possible that the extendable shroud maybe conveyed on a pair of trolleys, each trolley having a single wheel or a plurality of wheels driven through a track.

It is, therefore, a primary object of the present invention to provide a means for conveying material to be ground or pulverized from the source of such material to a grinder or hammermill, particularly of the pivot tub type. It is also an important objective of the present invention to provide a shroud which is readily extendable from the conveyor frame assembly over and above the pivot tub of the hammermill, the shroud preventing material which is introduced into the hammermill from being violently rejected from the hammermill during operation.

It is also an objective of the present invention to provide an extendable shroud which can be retracted so that the pivot tub of hammermill or grinder may be pivoted away from or otherwise removed from the mill for cleaning and service of the mill.

Another object of the present invention is to provide a readily transportable conveyor means for use with grinders and hammermills.

Additional objectives and advantages will become apparent and a more thorough and comprehensive understanding may be had from the following description taken in conjunction with the accompanying drawings forming a part of this specification.

BEST MODE FOR CARRYING OUT INVENTION

Figure 1:
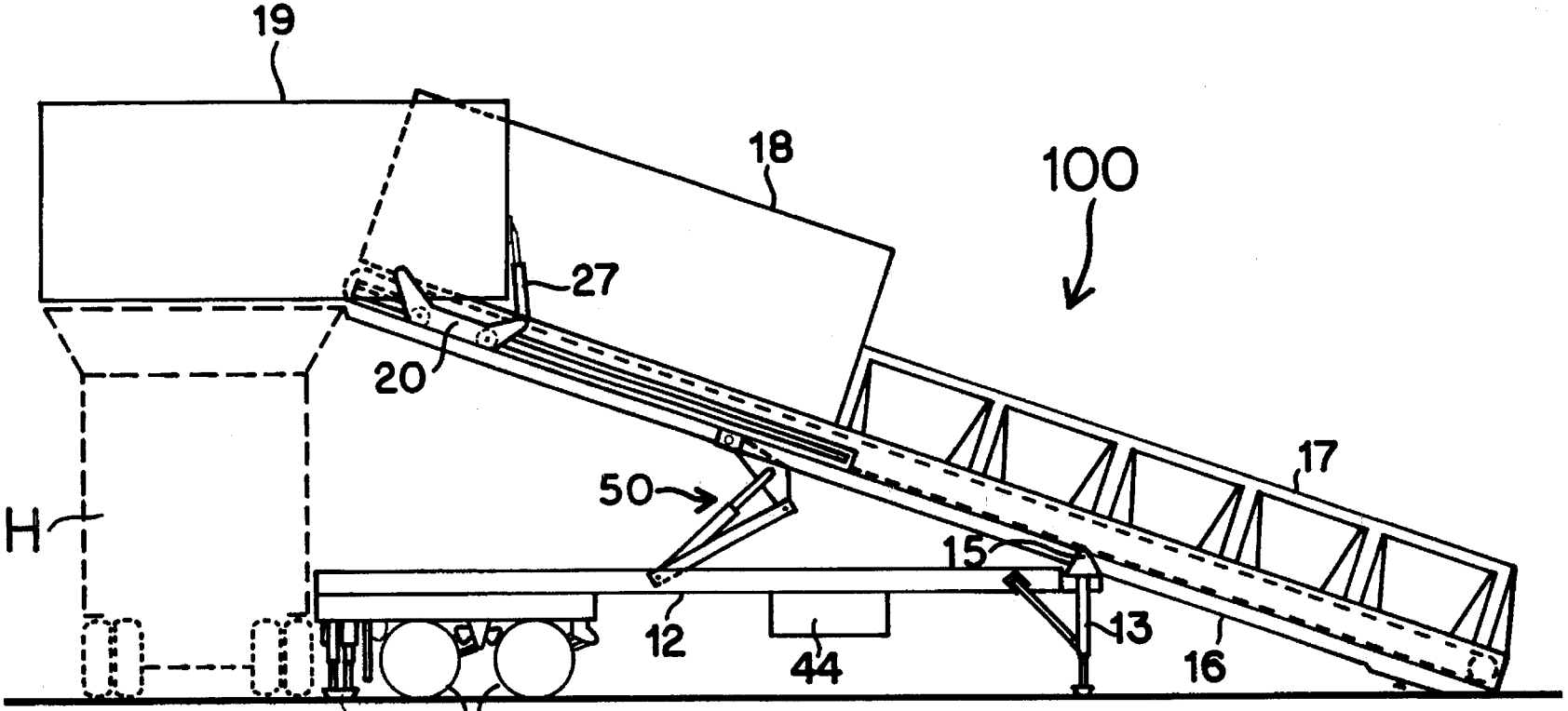
FIG. 1 is a side view of the conveyor with extending shroud showing the extendable shroud in its fully extended and horizontal position.
Figure 2:
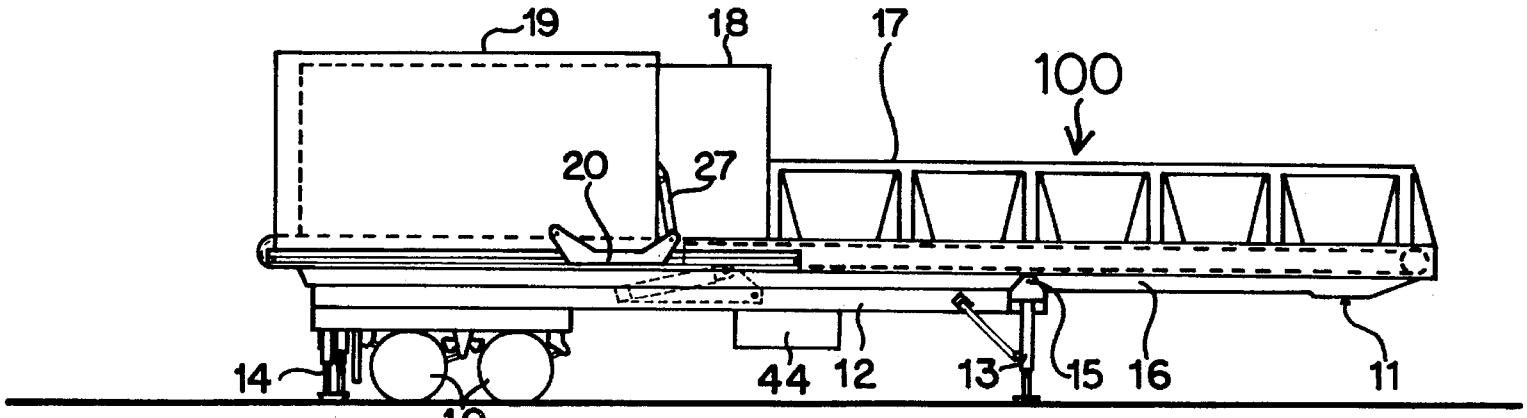
FIG. 2 is a side view of the conveyor with extending shroud configured for transport.
Figure 3:
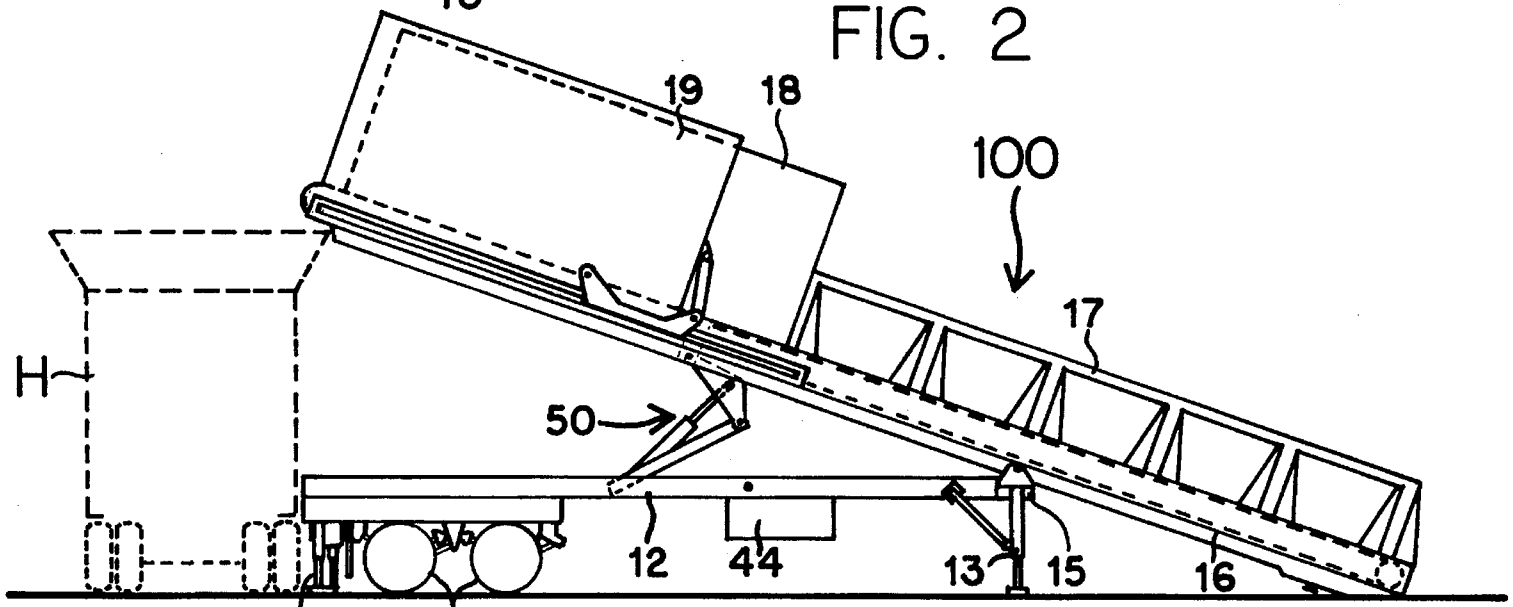
FIG. 3 is a side view of a conveyor with extending shroud showing the conveyor in the inclined position.

Referring now to FIGS. 1 through 3, the preferred embodiment of the conveyor with extending shroud 100 is shown to advantage. FIG. 1 shows conveyor with extending shroud 100 configured for use. Conveyor with extending shroud 100 is positioned adjacent to a hammermill H. Front leveling struts 13 and rear leveling struts 14 are extended until they are in contact with the ground so that conveyor with extending shroud 100 may be operated from a sturdy and level stance.

Conveyor frame assembly 16 which is pivotally attached to transport frame assembly 12 is tilted into position by means of conveyor frame tilt assembly 50.

Referring now to FIG. 3, extendable shroud 19 is shown in a retracted position. Extendable shroud 19 is so positioned during transport of conveyor with extending shroud 100 and also during servicing of hammermill H.

Referring again to FIG. 1, extendable shroud 19 is shown extended out over and above hammermill H. FIG. 1 also shows fixed shroud 18 to advantage.

Figure 4:
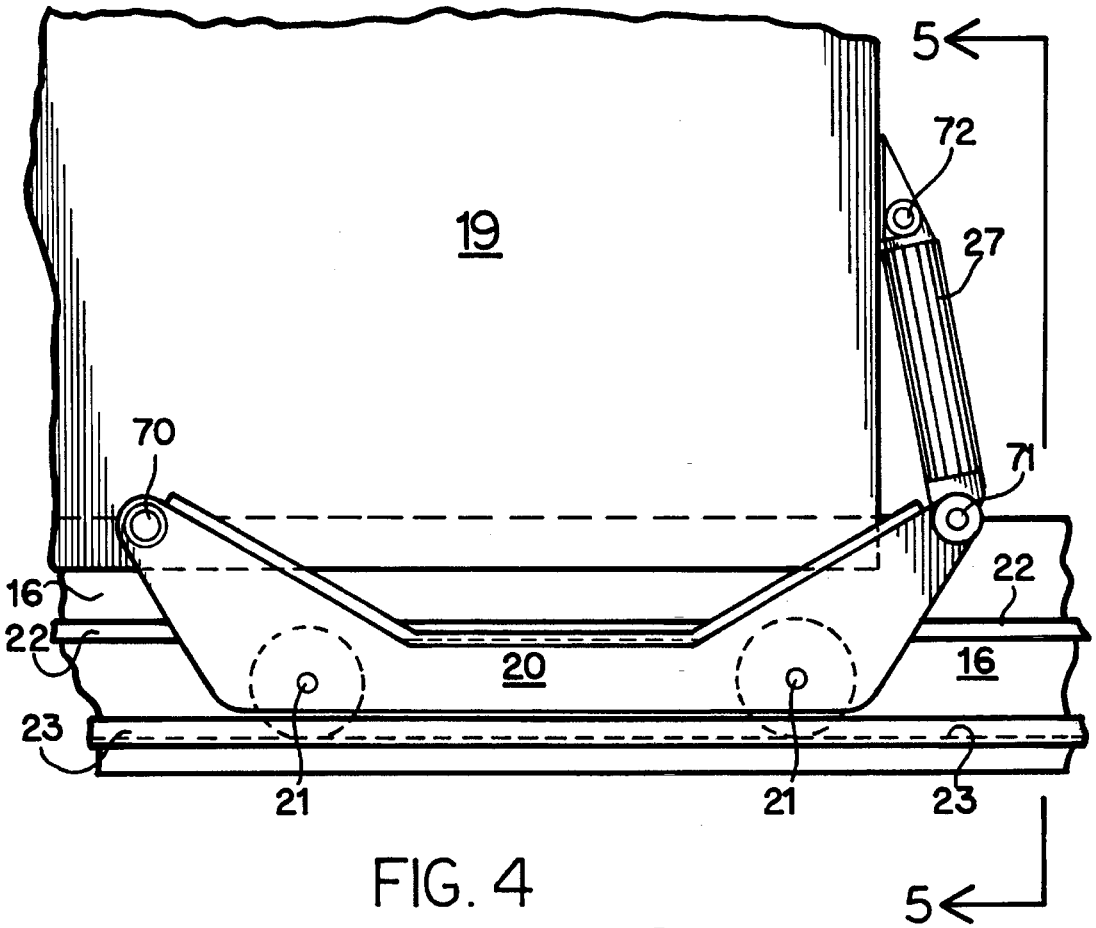
FIG. 4 is a side view detail of the conveyor with extending shroud's right side trolley assembly.
Figure 5:
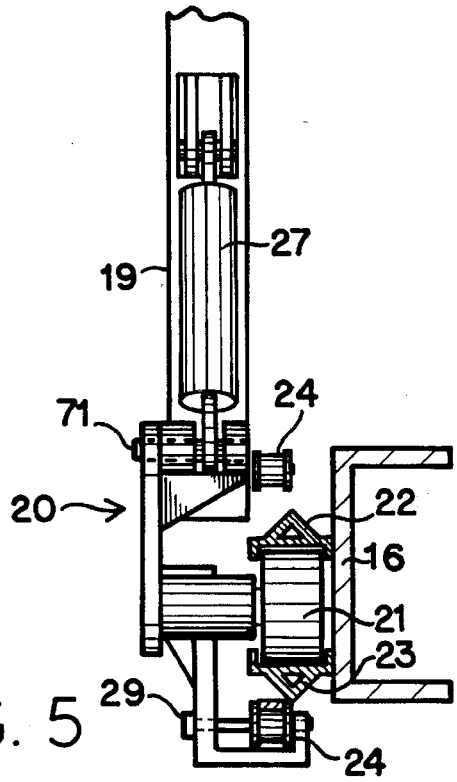
FIG. 5 is a cross-sectional detail of the conveyor with extending shroud's right side trolley assembly showing the trolley, wheel, track roller chain and leveler assemblies taken along line 5—5 of FIG. 4.

Referring to FIGS. 4 and 5, there is shown trolley assembly 20 which is operatively mounted on the right side of conveyor frame assembly 16 within right trolley upper track assembly 22 and right trolley lower track assembly 23. Trolley 20 is mounted on wheels 21 and is pivotally attached at one end to extendable shroud 19 by right trolley/shroud pin 70. The opposite end of trolley 20 is pivotally attached to right trolley shroud leveler 27 by right trolley/leveler pin 71. Right trolley shroud leveler 27 is attached at its second end to extendable shroud 19 by right leveler/shroud pin 72.

In the preferred embodiment, a similar trolley assembly to that just described for the right side is also provided on the left side of conveyor frame assembly 16, so that extendable shroud 19 is driven and leveled evenly from both its right and left side to avoid binding within the track assemblies and to promote smooth operation.

FIG. 5 is a sectional view showing conveyor frame assembly 16 with the associated right trolley assembly 20 slidably attached thereto. Right trolley wheel assembly 21 is located within right trolley upper track assembly 22 and right trolley lower track assembly 23. Right trolley wheel assembly 21 is rotatable mounted to right trolley assembly 20 by means of right trolley wheel hub assembly 28.

FIG. 5 also shows right roller chain 24 fixedly attached to right trolley assembly 20 by right roller chain pin 29. Additionally, FIG. 5 shows right trolley shroud leveler 27 pivotally attached to right trolley assembly 20 by right trolley/leveler pin 71.

Once again, an assembly similar to that described in FIG. 5 is provided on the left side of the preferred embodiment of the apparatus.

Figure 6:
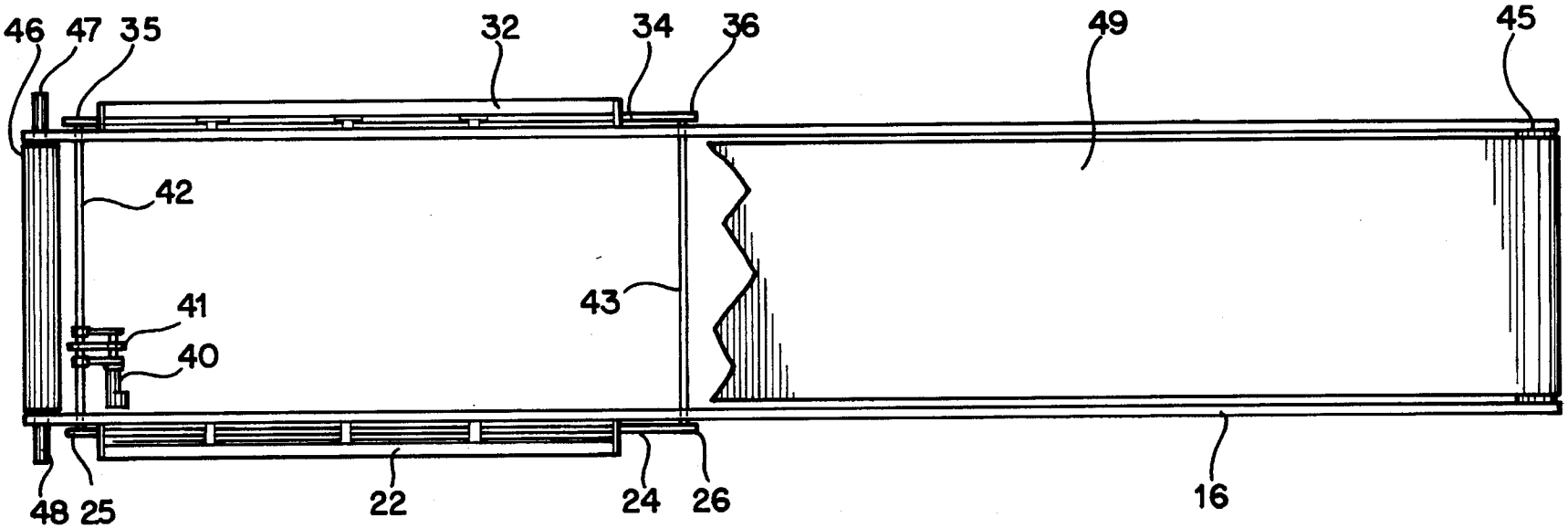
FIG. 6 is top view sectional detail of the conveyor with extending shroud's conveyor frame assembly.

FIG. 6 is a sectional detail through conveyor frame assembly 16 showing to advantage numerous features of the present invention. Conveyor belt 49 forms a continuous loop which extends from one end of conveyor frame assembly 16 to the other, at one end being carried by conveyor tail roller 45, and at the opposite end being carried by conveyor drive roller 46. Conveyor drive roller 46 is powered by right conveyor hydraulic motor 48 and left conveyor hydraulic motor 47.

Referring to FIGS. 4 and 6, right trolley assembly 20 and left trolley assembly (not shown) are mounted respectively within right trolley upper track assembly 22, right trolley lower track assembly 23, left trolley upper track assembly 32 shown in FIG. 6, and left trolley lower track assembly (not shown). The trolley assemblies are driven respectively by right trolley roller chain 24 and left trolley roller chain 34. Left trolley roller chain 34 is driven in turn by left trolley drive sprocket 35 attached to one end of trolley assembly drive axle 42. Similarly, right trolley roller chain 24 is driven by right trolley drive sprocket 25, which is attached at the opposite end of trolley assembly drive axle 42. Trolley drive axle 42 is mounted at either end within conveyor frame assembly 16. Similarly, trolley assembly idler axle 43 is mounted at either end to conveyor frame assembly 16. A first end of trolley assembly idler axle 43 carries left trolley idler sprocket 36 and the second end carries right trolley idler sprocket 26. Right and left trolley roller chains 24 and 34, respectively, pass over and are carried by right and left trolley idler sprockets 26 and 36, respectively. Trolley assemble drive axle 42 is driven by trolley assembly hydraulic motor 40, which is operatively connected to trolley assembly drive axle 42 by means of trolley assemble chain drive 41 having a chain and sprocket.

Figure 7:
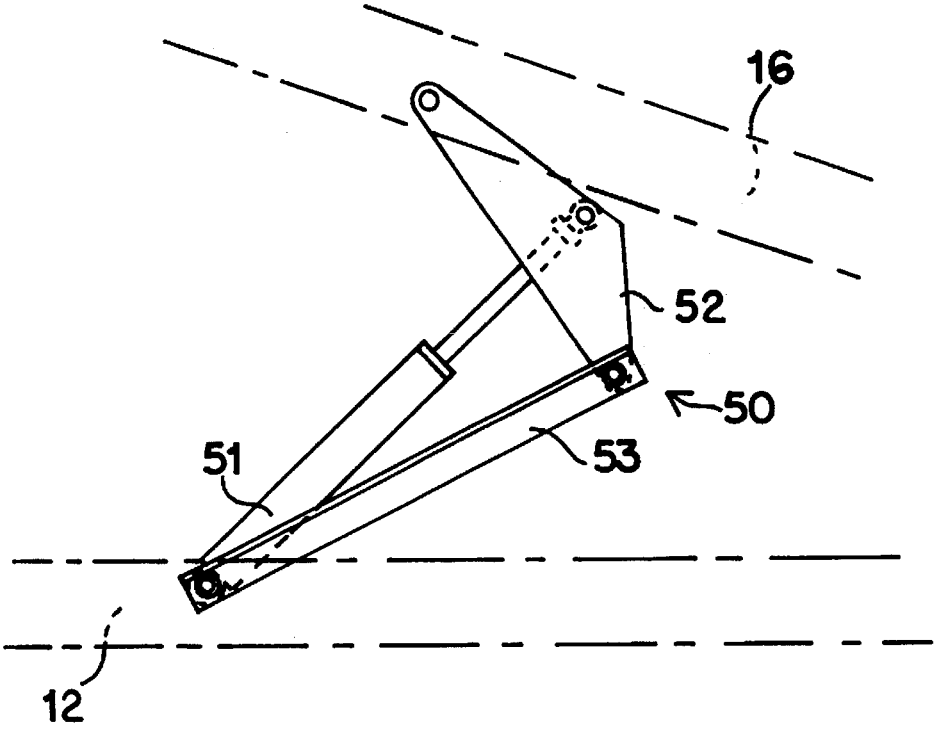
FIG. 7 is a detail side view of the conveyor frame tilt assembly in the elevated position.
Figure 8:
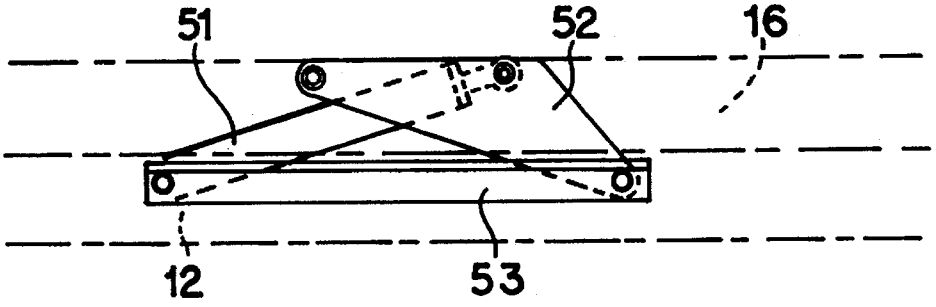
FIG. 8 is a detail side view of the conveyor frame tilt assembly.
Figure 9:
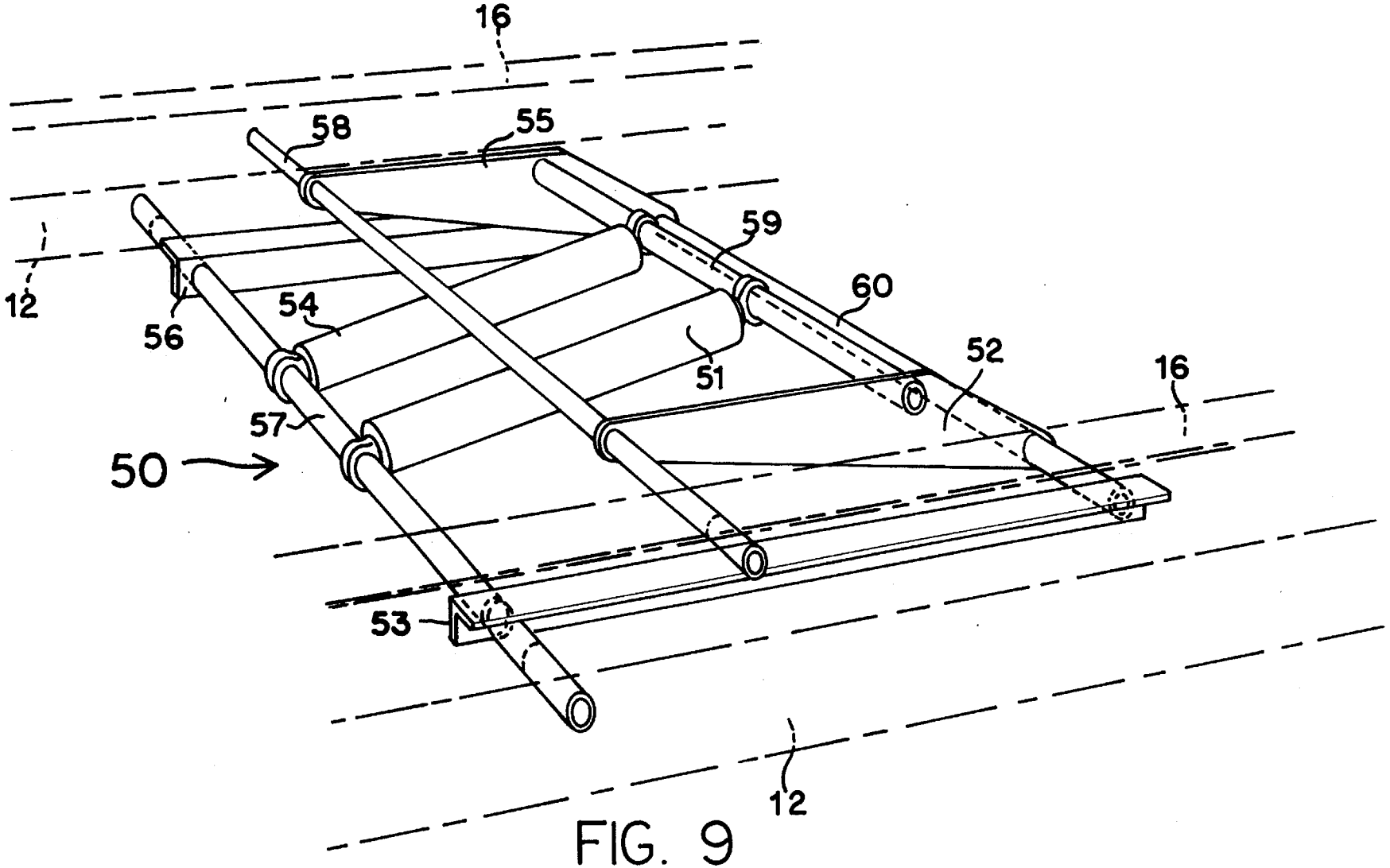
FIG. 9 is a perspective of the conveyor frame tilt assembly.

Referring now to FIGS. 7, 8 and 9, conveyor frame tilt assembly 50 is shown to advantage. Conveyor frame tilt assembly 50 consists essentially of a pair of hydraulic rams, left hydraulic ram 51 and right hydraulic ram 54. A first end of each hydraulic ram is pivotally attached to transport frame pin 57, which in turn is pivotally mounted at both its first and second ends within transport frame assembly 12. The second ends of left hydraulic ram 54 and right hydraulic ram 51 are pivotally mounted to base lever pin 60, which in turn is pivotally attached at either of its two ends to left fulcrum lever 52 and right fulcrum lever 55. Right fulcrum lever 55 is pivotally attached at a first end to conveyor assembly frame pin 58, which spans conveyor assembly frame 16 and is pivotally attached at either of its two ends to conveyor frame assembly 16.

Similarly, left fulcrum lever 52 is pivotally attached at one of its two ends to conveyor frame pin 58. The opposite end of left fulcrum lever 52 is pivotally attached to base lever pin 60. Similarly, a second end of right fulcrum lever 55 is pivotally attached to base lever pin 60. A first end of base lever pin 60 is pivotally attached to left base lever 53 and a second end of base lever pin 60 is pivotally attached to right base lever 56. A second end of left base lever 53 is pivotally attached to transport frame pin 57. Similarly, a second end of right base lever 56 is pivotally attached to transport frame pin 57.

Referring to FIGS. 1, 4, 6 and 9, the various hydraulic systems of the preferred embodiment are powered by a hydraulic system, including engine pumps and hydraulic fluid reservoir and connecting fluid lines 44, schematically shown. The various hydraulic systems include conveyor frame tilt assembly 50, front leveling struts 13, rear leveling struts 14, left conveyor hydraulic motor 47 and right conveyor hydraulic motor 48, trolley assembly hydraulic motor 40, right trolley shroud leveler 27, and left trolley shroud leveler (not shown).

Referring now to FIGS. 1 through 9, in operation, conveyor with extending shroud 100 is transported to a site where material is to be loaded into a hammermill H. Transport of the preferred embodiment is typically accomplished by a 10-wheel tractor, (not shown), which is attached to the conveyor with extending shroud 100 by means of hitch pin 11, while the apparatus itself rolls freely on wheel assemblies 10. Once in position, front leveling struts 13 and rear leveling struts 14 are extended, so that the weight of conveyor with extending shroud 100 is taken in part off of wheel assemblies 10, and the apparatus can be leveled or otherwise setup for operation.

Next, conveyor frame assembly 16 is tilted up and away from transport frame assembly 12 by means of conveyor frame tilt assembly 50. Right hydraulic ram 51 and left hydraulic ram 54 are extended, expanding against transport frame pin 57 and base lever pin 60. As the hydraulic rams expand, right fulcrum lever 52 and left fulcrum lever 55 rotate about fulcrum lever 59, causing conveyor frame assembly 16 to pivot on conveyor assembly pivots 15, tilting up and away from transport frame assembly 12. Once conveyor with extending shroud 100 is positioned with conveyor frame assembly 16 tilted up and away from transport frame assembly 12, trolley assembly hydraulic motor 40 is actuated, causing right trolley roller chain 24 and left trolley roller chain 34 to be driven by right trolley drive sprocket 25 and left trolley drive sprocket 35, respectively. Right roller chain 24 forms a continuous loop being driven by right trolley drive sprocket 25 and traveling around right trolley idler sprocket 26. FIG. 5 shows the bottom leg of right roller chain 24 affixed to right trolley assembly 20 by means of right roller chain pin 29, which extends through right trolley assembly 20 and right trolley chain 24. The upper leg of right trolley roller chain 24 passes freely by right trolley assembly 20 as the continuous loop is driven by right trolley drive sprocket 25 and traveling around right trolley idler sprocket 26.

Similarly, left trolley roller chain (not shown) is affixed to left trolley assembly (not shown) by means of a left roller chain pin (not shown).

Similarly, left trolley roller chain (not shown) forms a continuous loop, being driven by left trolley drive sprocket (not shown), traveling around left idler sprocket, (not shown), and is affixed to left trolley assembly, (not shown), by means of a left roller chain pin, (not shown), which extends through left trolley assembly, (not shown), and left trolley chain, (not shown).

Right trolley assembly 20 advances on right trolley wheel assemblies 21, which are attached to right trolley 20 by right trolley wheel hub assemblies 28, within right trolley upper track assembly 22 and right trolley lower track assembly 23.

Similarly, left trolley wheel assemblies (not shown) advance within upper and lower left trolley track assemblies (not shown) and are similarly attached to left trolley assembly (not shown) by a left trolley wheel hub assembly (not shown).

As the trolleys advance in their respective tracks, extendable shroud 19 advances past fixed shroud 18 to a point where the respective trolleys reach a limit of travel in their respective tracks. At this point, right shroud leveler 27 and a left trolley shroud leveler (not shown) are hydraulically extended tilting extendable shroud 19 from its inclined position to a relatively level position over and above hammermill H.

Material to be ground or pulverized is deposited at the end of conveyor with extendable shroud 100 and the material travels up conveyor belt 49, which is driven by left conveyor hydraulic motor 47 and right conveyor hydraulic motor 48. Conveyor belt 49 travels in a continuous loop around conveyor drive roller 46 and conveyor tail roller 45.

The material to be ground or pulverized travels past conveyor frame rail 17, through fixed shroud 18, where it is deposited into the pivot tub of hammermill H. Extendable shroud 19 guides the material to be crushed or pulverized into hammermill H, and prevents a rejection of material from the hammermill by blocking the ejection of material from the hammermill H.

While there is shown and described the present preferred embodiment of the invention, it is to be distinctly understood that this invention is not limited thereto but may be variously embodied to practice within the scope of the following claims.

I claim:

1. A transportable conveyor system for use primarily with a pivot tub type hammermill comprising:

a transport frame;

wheel assemblies for transport attached to the transport frame;

front and rear jack assemblies attached to the transportable conveyor system for positioning and stabilizing the transportable conveyor system;

a conveyor frame pivotally attached to the transport frame, the conveyor frame having first and second sides and first and second ends;

means for inclining the conveyor frame relative to the transport frame;

a conveyor means installed within the conveyor frame, for transporting the material to be ground or pulverized to the hammermill;

rails located on either side and attached to the first end of the conveyor frame for containing the material to be ground or pulverized on the conveyor means;

a fixed shroud located at and attached to the second end of the conveyor frame extending upward from the frame and across the top of the conveyor means creating an enclosure through which the material to be ground or pulverized travels;

an extendable shroud slidably mounted on a pair of trolleys, extending upward from the trolleys and across the top of the fixed shroud, one trolley mounted on either side of the conveyor frame, each trolley traveling on a plurality of wheels, each wheel being in slidable engagement with one of a pair of tracks, the first track being attached to the conveyor frame first side and the second track being attached to the conveyor frame second side, the trolleys having means for driving the trolley wheels along the track causing the extendable shroud to extend past the second end of the conveyor frame; and means for tilting the extendable shroud to level the shroud over the pivot tub of the hammermill.

2. The conveyor of claim 1 wherein the means for tilting and leveling the extendable shroud means further comprises a pair of hydraulic rams, each hydraulic ram having a first and second end, the first end of each hydraulic ram being pivotally attached to each of the two trolleys, and the second end of each hydraulic ram being pivotally attached to the extendable shroud means.

* * * * *